US006669197B1

(12) United States Patent
Lund et al.

(10) Patent No.: US 6,669,197 B1
(45) Date of Patent: Dec. 30, 2003

(54) BOARD GAME

(76) Inventors: Bruce D. Lund, 2557 W. Pensacola, Chicago, IL (US) 60618; Joe Mills, 5220 N. Rockwell St., Apt. GS, Chicago, IL (US) 60625

( * ) Notice: Subject to any disclaimer, the term of this patent is extended or adjusted under 35 U.S.C. 154(b) by 0 days.

(21) Appl. No.: 10/214,500

(22) Filed: Aug. 9, 2002

(51) Int. Cl.[7] ..... A63F 3/00
(52) U.S. Cl. ..... 273/243; 273/287; 273/141 A
(58) Field of Search ..... 273/237, 243, 273/280, 282, 138.1, 141 R, 141 A, 138.2, 148 R; D21/374

(56) References Cited

U.S. PATENT DOCUMENTS 4,244,568 A * 1/1981 Ferris et al. ..... 273/445
4,679,793 A * 7/1987 Gonzalez ..... 273/317.3
4,852,886 A * 8/1989 Zaruba et al. ..... 273/249

* cited by examiner

*Primary Examiner*—Benjamin H. Layno
*Assistant Examiner*—Vishu Mendiratta

(57) ABSTRACT

A board game includes a board having a plurality of spaces displaced about a centered area forming a pre-determined continuous path. At least one token assigned to a player for moving about the plurality of spaces in accordance with chance determinations. A random movement means for randomly determining numbers of spaces to be moved by a player. A randomly moveable sinuous arm extending from the centered area, the sinuous arm at any point during the game may have a length that extends over the pre-determined continuous path, wherein when the sinuous arm moves over the pre-determined continuous path, the sinuous arm may come into contact with a token physically displacing the token off of the path.

6 Claims, 1 Drawing Sheet

BOARD GAME

BACKGROUND OF THE INVENTION

The present invention relates to board games, and more particularly to board games that include pieces moved along a path. Board games have been around for many years, and while there have been numerous varieties of board games there are always a continual need for improvements and new and novel features.

SUMMARY OF THE INVENTION

In accordance with the present invention a board game includes a board having a plurality of spaces displaced about a centered area forming a pre-determined continuous path. At least one token is assigned to a player for moving about the plurality of spaces in accordance with chance determinations. A random movement means for randomly determining numbers of spaces to be moved by a player. A randomly movable sinuous arm extending from the centered area, the sinuous arm at any point during the game may have a length that extends over the pre-determined continuous path, wherein when the sinuous arm moves over the pre-determined continuous path, the sinuous arm may come into contact with a token physically displacing the token off of the continuous path.

The sinuous arm preferably includes a plurality of interconnecting pivotal segments such that the movement of the entire arm is random or snake or coiled-like. The sinuous arm is moveably connected to a motor mechanism, which preferably includes a motor mechanism that changes its rotational direction.

The objective of the game is to be the player that successfully carries an icon or number of icons around the continuous path to a finish space, without being knocked off by the sinuous arm.

Numerous other advantages and features of the invention will become readily apparent from the following detailed description of the invention and the embodiments thereof, from the claims, and from the accompanying drawings.

BRIEF DESCRIPTION OF THE DRAWINGS

A fuller understanding of the foregoing may be had by reference to the accompanying drawings, wherein.

DETAILED DESCRIPTION OF THE EMBODIMENTS

Figure 1:
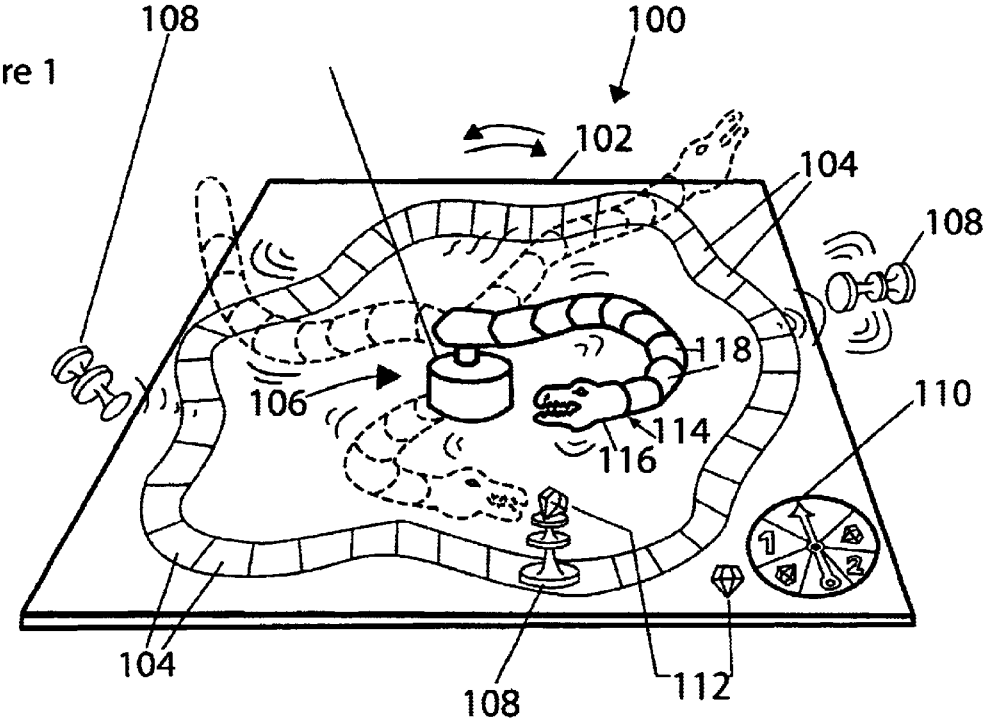
FIG. 1 illustrates a board game in accordance with the present invention.

While the invention is susceptible to embodiments in many different forms, there are shown in the drawings and will be described herein, in detail, the preferred embodiments of the present invention. It should be understood, however, that the present disclosure is to be considered an exemplification of the principles of the invention and is not intended to limit the spirit or scope of the invention and/or claims of the embodiments illustrated.

Referring now to FIG. 1, there is shown a board game 100 in accordance with the present invention. The board game 100 includes a board 102 with a plurality of spaces 104 that make a predetermined continuous path around a centered area 106. While not shown in detail the continuous path would include a start and a finish space, it being further noted that the start and finish space may occupy the same space on the continuous path. Each player would select a token 108 and place it on the designated starting space. A random determining means, such as a spinner 110 or dice would be used to determine the numbers of spaces to be moved by the player. Also included on the continuous path are token icon spaces (not shown), which upon landing on a token icon space, the user would place a token icon 112 on top of the token 108.

Positioned about the centered area 106 is a sinuous arm 114. As depicted in the illustrations FIGS. 1 and 2, the sinuous arm 114 preferably has the appearance of a dragon head 116 connected to the centered area 106 by a plurality of interconnecting body segments 118. Pins 120 connect the body segments 118 such that the interconnecting body segments 118 may pivot separately from each other. While the pins 120 are depicted as separate elements, they may also be molded into the body segments 118, such that the segments 118 may snap together for easy assembly/disassembly. This makes them hinge relative to one another creating a sinuous movement often found in serpent like creatures. The sinuous arm 114 has a pre-determined length that permits it to extend over the continuous path at any given moment. If the sinuous arm 114 travels over the continuous path and comes in contact with a token 108, the sinuous arm 114 may physically displace the token 108 by knocking the token 108 off of the board 102 or may physically displace a token icon 112 off of the token 108. A further explanation of the rules and objectives of the game are explained in greater detail below.

Figure 2:
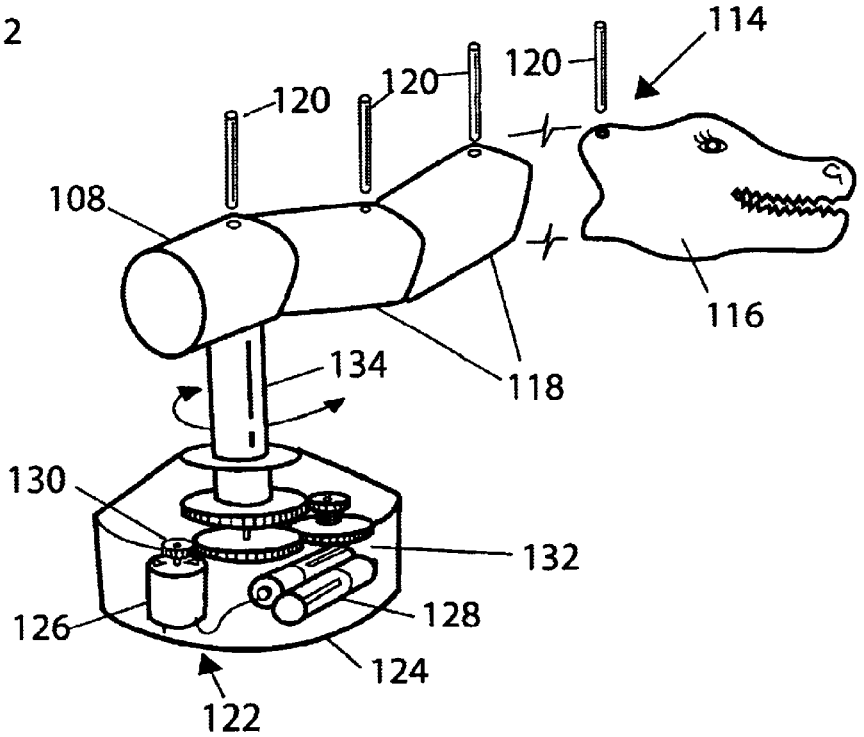
FIG. 2 illustrates a sinuous arm that randomly moves around the board game in an attempt to knock the player's tokens off of a continuous path.

Referring now to FIG. 2, the sinuous arm 114 is controlled and moved by a motor mechanism 122 positioned in a housing 124. The housing 124 is further attached to the centered area 106 on top of the board 102. The motor mechanism 122 preferably changes its rotational direction, such that the movement along the sinuous arm 114 is random causing it to coil and twist about the board. The motor mechanism 122 includes a motor 126 and a power supply 128. A motor gear 130 operatively controlled by the motor 126 is meshed to a gear train 132 that ultimately drives an axle 134. The axle 134 is secured to one of the body segments 118, such that when rotating the segments 118 will begin to move.

Game play is described as having a plurality of players selectively choose a token 108. Each token 108 is placed on a start space and the players begin to move by spinning the spinner 110 or rolling a die to determine how many spaces the player's token should be moved. If a player lands on a token icon space the player places a token icon 112 on top of their token. During play the sinuous arm 114 randomly moves about the board, oftentimes extending over the continuous path. At any given point in the game the sinuous arm 114 may strike a player's token, knocking the token off of the path or board or knocking an icon off of the token. At which point the player having their token knocked off the path or board may be required to restart at the start space or if only an icon is knocked off may be able to continue from the same space. The object of the game is for one of the players to successfully carry a token or a multiple of tokens to the finish space. Since the path is continuous the players will continue to move along the path until someone wins.

Variations of the game may be readily seen from the embodiment described above, for example, cards may be used to determine movements and whether a player receives an icon. Alternatively, the object of the game may be simply to move successfully around the board without being struck by the sinuous arm. The board itself may include valleys and hills such that a token on a hill may be more exposed to the sinuous arm as opposed to a token in a valley. From the foregoing and as mentioned above, it will be observed that numerous variations and modifications may be effected without departing from the spirit and scope of the novel concept of the invention. It is to be understood that no limitation with respect to the specific methods and apparatus illustrated herein is intended or should be inferred. It is, of course, intended to cover by the appended claims all such modifications as fall within the scope of the claims.

We claim:

1. A path game for a number of players comprising in combination:

a board having a plurality of spaces displaced about a centered area forming a pre-determined continuous path, the continuous path having a start and a finish; at least one token assigned to each player for moving the token about the plurality of spaces from the start to the finish of the path in accordance with chance determinations; random movement means for randomly determining the number of spaces to be moved by a player, and a sinuous arm extending from said area and randomly movable by a motor mechanism, the sinuous arm includes a plurality of sections pivotally interconnected to form snake-like movements and has an appearance of a neck of an animal and includes a head of said animal attached thereto, the sinuous arm at any point during movement may have a length that extends over said predetermined continuous path, wherein when said sinuous arm moves over said predetermined continuous path, the sinuous arm may come into contact with a token physically displacing said token off of said continuous path.

2. The game of claim 1 wherein the area includes a housing enclosing the motor mechanism and positioned on top of the board such that the sinuous arm is positioned a predetermined distance above the board.

3. The game of claim 1 wherein the random movement means includes but is not limited to either a dice or a spinner.

4. The game of claim 1 wherein the plurality of spaces includes a number of token icon spaces that indicate to a player, that lands a token on a token icon space, to place an icon on top of said token.

5. The game of claim 1 wherein the motor mechanism rotates the sinuous arm in two rotational directions.

6. A game comprising a board having a plurality of spaces displaced about a centered area forming a predetermined continuous path; the board containing upward and downward slopes, at least one token assigned to a player for moving about the plurality of spaces in accordance with chance determinations, a random movement means for randomly determining the number of spaces to be moved by a player; and a randomly movable sinuous arm extending from said centered area, the sinuous arm at any point during the game may have a length that extends over said predetermined continuous path, wherein when said sinuous arm moves over said predetermined continuous path, the sinuous arm may come into contact with a token physically displacing said token off of said continuous path.

* * * * *